US006163301A

United States Patent [19]

Widfeldt

[11] Patent Number: 6,163,301

[45] Date of Patent: Dec. 19, 2000

[54] ANTENNA DEVICE FOR TRANSMITTING AND RECEIVING RF SIGNALS

[75] Inventor: Johan Widfeldt, Stockholm, Sweden

[73] Assignee: Allgon AB, Akersberga, Sweden

[21] Appl. No.: 09/357,284

[22] Filed: Jul. 20, 1999

[30] Foreign Application Priority Data

Jul. 24, 1998 [SE] Sweden ..... 9802617

[51] Int. Cl.[7] ..... H01Q 1/24

[52] U.S. Cl. ..... 343/702; 343/895; 343/901

[58] Field of Search ..... 343/702, 900, 343/901, 895

[56] References Cited

U.S. PATENT DOCUMENTS

| | | | |
|---|---|---|---|
| 5,605,163 | 2/1997 | Hani | 128/772 |
| 5,717,409 | 2/1998 | Garner et al. | 343/702 |
| 6,008,765 | 12/1999 | Davidson et al. | 343/702 |
| 6,031,496 | 2/2000 | Kuittinen et al. | 343/702 |
| 6,041,106 | 1/2000 | Annamaa | 343/702 |

FOREIGN PATENT DOCUMENTS

| | | |
|---|---|---|
| 9-232837 | 9/1997 | Japan . |
| WO94/28593 | 12/1994 | WIPO . |
| WO97/23014 | 6/1997 | WIPO . |

*Primary Examiner*—Tan Ho

*Attorney, Agent, or Firm*—Jacobson, Price, Holman & Stern, PLLC

[57] ABSTRACT

An antenna device for portable communication equipment and including an extendable elongated antenna element which at its lower part includes first and second contact surfaces and which is slidable inside a casing between an extended position and a retracted position. The first and second contact surfaces are arranged for engagement with an inner surface of the casing, and a third contact surface is arranged for engagement with the elongated antenna element. The contact surfaces are arranged so as to create a spring force in the elongated antenna element so as to achieve mechanical locking in the extended position.

20 Claims, 4 Drawing Sheets

ANTENNA DEVICE FOR TRANSMITTING AND RECEIVING RF SIGNALS

FIELD AND BACKGROUND OF THE INVENTION

The invention relates to an antenna device for transmitting and receiving RF-signals from and to a radio communication device, comprising: an extendable elongated flexible antenna element having first and second ends, whereof the first end has a first end portion; a casing through which said antenna element is slidable between an extended position, where the first end portion is mechanically locked in the casing, and a retracted position; and, a first opening in a first end of the casing through which the first end portion of said antenna element can be introduced, and a second opening in a second end of the casing through which the antenna element is slidable. Specifically, it relates to an antenna device for a mobile radio communication device, e.g. a hand-portable telephone.

Such an antenna device is previously known from WO 94/28593, wherein an antenna rod at its lower region is provided with a rigid stopper element which, in the extended position, cooperates with a resilient sleeve member so as to obtain a locking force between these parts.

The prior art device is well functioning, however, relatively space-demanding in the axial direction, since the sleeve construction necessarily have relatively large axial dimensions and because the end portion of the stopper element appearing on the outside of the sleeve in the extended position. Further, a device based on the prior art solution includes several separate details such as a sleeve, a spring ring for the sleeve, a screw portion and a stopper element, resulting in correspondingly high costs for manufacture, on the one hand of the separate elements and on the other hand for assembly of the elements. The use of several elements also results in accumulated and more widely spread tolerances. Further, the use of springs and separate details including springs put hard requirements on the design and the materials, in order to achieve long durability.

SUMMARY OF THE INVENTION

It is an object of this invention to provide an antenna device of the above mentioned type wherein the prior art problems are eliminated or at least reduced.

This is achieved by that: the first end portion is provided with first and second contact surfaces for engagement with an inner surface of the casing; the first and second contact surfaces are axially separated in relation to a longitudinal axis of the elongated antenna element and facing in different directions; a third contact surface is arranged for engagement with the elongated antenna element between the first end portion and the second end; and, the contact surfaces, the casing and the elongated antenna element are arranged so as to bend the elongated antenna element to create a spring force in the elongated antenna element in order to achieve said mechanical locking in the extended position.

This way the antenna device contains only one movable part, the elongated antenna element, thus reducing costs for production and assembly.

Further important features of the invention are reduced weight, and requirement only for a small space.

By the arrangement of contact surfaces in the end portion of the elongated antenna element an antenna device is achieved which can be produced in a simple process at reduced costs, compared to prior art devices. When the contact surfaces are provided on an enlarged portion, the enlarged portion can be manufactured by moulding (e.g. press moulding or metal injection moulding), which contributes to the cost reduction.

By using a portion of the elongated antenna element as a spring for obtaining the stopping or retaining function in extended position, a longer spring length than in prior art devices can be achieved. This is very advantageous, since constructions with long spring lengths are not so sensitive, and the stop or retaining force do not depend on high tolerances, and they are therefore very stable. For prior art constructions, having short spring lengths, the contrary is valid. They are more sensitive, and the stop or retaining force more depends on high tolerances, and there is a risk for unstability.

By the introduction of a bending force in the elongated antenna element, rattling (i.e. vibrations in the antenna element due to external forces) is avoided or at least reduced.

By the arrangement of a constriction or shoulder at the second end of the casing, the space required can be reduced since no stopper element outside the casing is needed.

By the contact surface being convex or rounded, i.e. curved in two perpendicular directions, it is assured that the pulling force variation is minimized and this provision also results in a smooth movement when the extended position is established.

By the arrangement of an antenna element (e.g. a helical radiator or a meandering radiator) at least partially surrounding the elongated antenna element, it is achieved an improved antenna device, with good performance in stand-by mode when the elongated antenna element is in the retracted position, and with good performance in call mode when the elongated antenna element is in the extended position.

DESCRIPTION OF PREFERRED EMBODIMENTS

Figure 1:
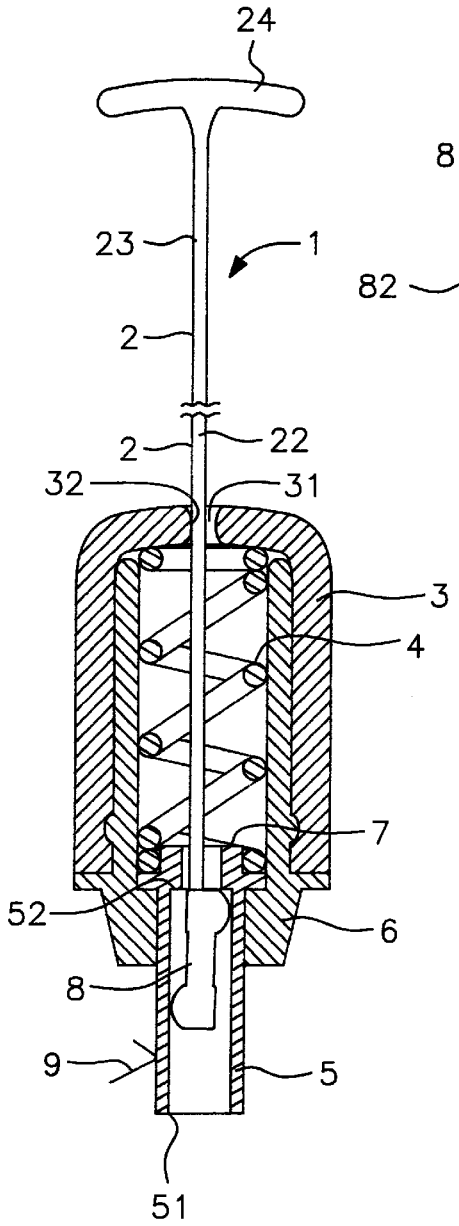
FIG. 1 is a diagrammatic partially sectional view of an antenna device, in extended position, according to a first embodiment of the invention.

The embodiment of FIG. 1 concerns an antenna device 1 for a mobile radio communication device, wherein an extendible antenna rod 2 is slidable inside a cover 3 of a helical radiator 4. At the bottom part of cover 3 a casing 5 is arranged and partly enclosed by a base member 6, which serves as a support onto which the cover 3 is mounted and in which the casing 5 is fastened. On the top of the casing 5 is a tubular member 7 provided, which serves as a retainer for the coil (helical radiator) 4. When the casing 5 (and also the tubular member 7) is made of a conductive material, RF energy is fed via this (those) between the coil and the transceiver circuits of the radio communication device. In the case the material of the casing 5 is non-conductive, the coil is fed via a feed portion and separate connection to the transceiver circuits of the radio communication device (not shown).

Figure 3:
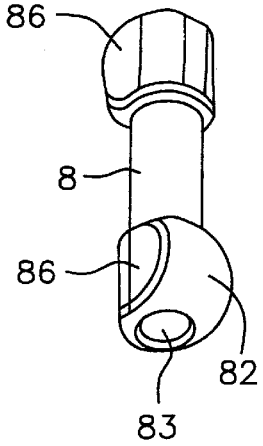
FIG. 3 is an enlarged perspective view of an enlarged portion of the antenna rod in FIG. 1.

The antenna rod 2 is an antenna element including an elongated radiating element 22, which may be made of nickel-titanium. The radiating element 22 is covered with an insulating and protecting layer except for a lower portion of the radiating element 22 which is to be introduced into a member forming an enlarged portion, as explained below. A top portion of the antenna rod 2 may be made of an insulating material 23, so that when in its retracted position, the radiating element 22 is not surrounded by the coil 4 (FIG. 3).

The antenna rod 2 is at its lower end provided with an enlarged portion 8. The enlarged portion 8 includes at each of its both ends a protruding part, having a curved surface 81, 82. The two curved surfaces 81, 82 face in different directions in relation to a longitudinal axis 21 of the elongated antenna element 2, preferably with a difference of 180°.

Figure 2:
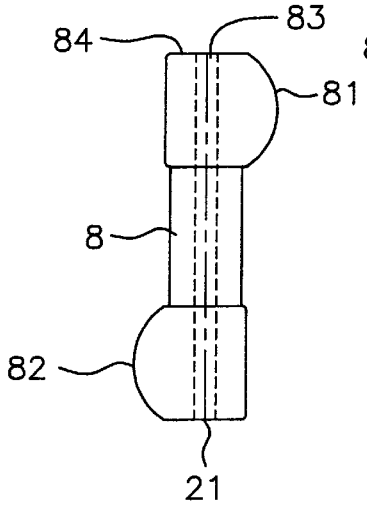
FIG. 2 is an enlarged diagrammatic side view of an enlarged portion of the antenna rod in FIG. 1.

As seen in FIG. 2, the enlarged portion 8 is a separate member which is provided with a through bore 83 for receiving the lower portion of the antenna rod 2 (and of the radiating element 22). The bore 83 is located in the centre of the enlarged portion 8, and the enlarged portion 8 is symmetric, so it has the same appearance and function when it is rotated 180° in the plane of the paper. The enlarged portion 8, is preferably made of zinc, which permits zinc metal moulding for its manufacture. It can also be produced by metal injection moulding (MIM). The enlarged portion 8 is secured to the antenna rod 2 by pressing, impressing in the enlarged portion 8, soldering, gluing or similar. Due to its symmetry the mounting of the enlarged portion 8 is simplified, since the end of the antenna rod 2 can be introduced into the bore 83 from either of its both openings, while the enlarged portion 8 will have the same form. Orientation of the separate member constituting the enlarged portion 8 is therefore not necessary during the manufacture, and a complicated step in the manufacturing process is hereby eliminated.

Figure 4:
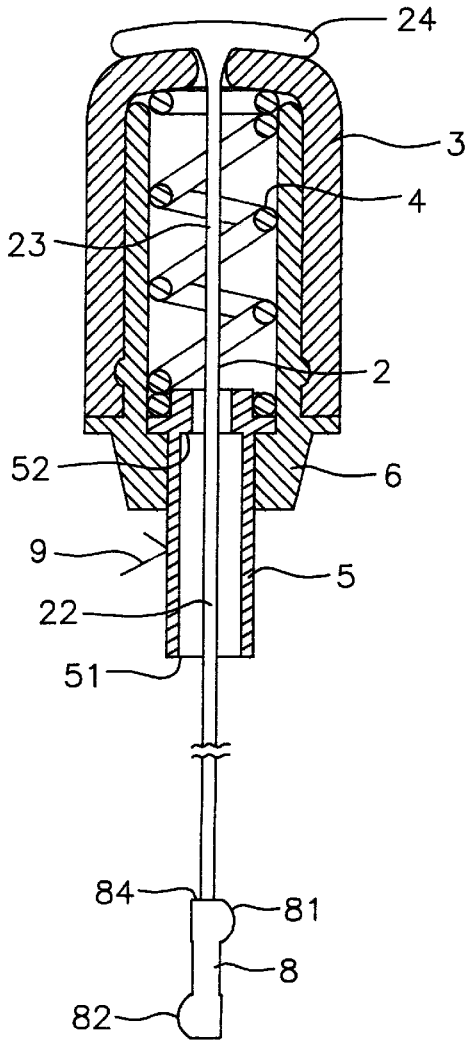
FIG. 4 is a diagrammatic partially sectional view of an antenna device, in retracted position, according to the first embodiment of the invention.

In FIG. 4 the antenna device is shown with the antenna rod 2 in its retracted position. The antenna rod 2 is moved to its extended position by pulling the knob 24, which also serves as a stopper for the retracted position. The antenna rod 2 then slides through the casing 5 and the cover 3, and exits through the opening 31. The opening 31 is circular, and exhibits a contact surface 32, which is annular. At the end of this movement the enlarged portion 8 will enter the casing 5 through the lower opening, first with the protruding part carrying the curved surface 81. The antenna rod 2, the contact surface 32, the protruding parts with their curved surfaces 81, 82, and the casing 5 are formed so that when the surface 82 enters the casing 5 it will contact the edge 51 and slide thereon until it slides on the inner surface of the casing 5, while the surface 81 slides on the inner surface of the casing 5 on the opposite side. When the surface 82 slides on the edge 51, the enlarged portion 8 is slightly rotated in the plane of the paper, and the antenna rod 2 is moved towards the contact surface 32 on the cover 3 until they are in contact. The rotation continues until the surface 82 slides on the inner surface of the casing 5. Then the antenna rod 2 will be slightly curved due to the spring force created therein by the flexibility of the antenna rod 2 and the pressure on the three contact surfaces (whereof two are included in the surfaces 81 and 82). The forms and locations of the surfaces 32, 81 and 82 are selected to obtain the desired spring force in the antenna rod 2. The spring force and the friction between the contact surfaces and the surfaces sliding thereon cause a resistance when the antenna rod 2 is pulled out. Also a desired retaining or locking function arises, so that the antenna rod 2 will remain in its extended position until it is exerted to a certain external force for its retraction. Thus, the locking or retaining function is mechanical, especially frictional.

When the antenna rod 2 has reached the extended position the top 84 of the enlarged portion 8 contacts the surface 52, which is a surface of a shoulder or constriction in the upper end of the casing 5, and further movement in the extension direction is prevented. The surface 52 is planar with an annular shape and can be contacted by the top 84 of the enlarged portion 8 in many ways, depending on the shape of the top 84. The contact region where the surface 52 and the top 84 are in contact could e.g. be annular or annularly distributed.

As seen in FIG. 3, each of the surfaces 81 and 82 is not only curved in a plane of the sliding movement but also in a plane perpendicular thereto, so as to form a convex surface. This curve shape is preferably conform with the inner surface of the casing 5, which preferably is circular cylindrical. The surfaces 86 are preferably essentially planar, and preferably parallel with corresponding surfaces on the opposite side.

Since the radiating element 22 of the antenna rod 2 is made of a flexible wire or rod, and the enlarged portion 8 is formed as a rigid member, which is rigidly secured to the antenna rod 2, the spring action is carried out by the radiating element 22.

The casing 5 shown is tubular and has a circular cross section. However, it can be formed with another cross section, preferably essentially conform with the cross section of the enlarged portion 8, in order to provide guiding of the enlarged portion 8 and the antenna rod 2, so that they can not be rotated around their longitudinal axes (or axis of the bore). The casing 5 can e.g. have planar wall sections parallel to the plane of the paper for the drawings.

When the casing 5 is made of a conductive material, RF energy is fed between the antenna rod 2 and the transceiver circuits of the radio communication device via the casing 5. A contact member 9 establishes a conductive contact between a PCB (printed circuit board) of the transceiver circuits and the casing 5. The contact pressure on the contact surfaces of the enlarged portion 8 and the corresponding surfaces of the casing 5 are sufficient for conductive contact establishment. Since the enlarged portion 8 is attached to the radiating element 22 so that they are in good conductive contact, RF energy can thus be fed to and from the antenna rod 2.

In the case when the casing 5 is made of a non-conductive material, RF energy can be coupled to and from the antenna rod 2 via the coil 4, capacitively and/or inductively, or by capacitive and/or inductive coupling means, e.g. arranged in or on the base member 6.

For the mounting of the antenna device, the lower region of the casing 5 or cover 3 may comprise a threaded portion for threaded engagement with a portable piece of communication equipment. Alternatively the casing 5 or cover 3 can be provided with means for snap in engagement with the portable piece of communication equipment. When the casing 5 is used for the physical mounting of the antenna device, the mounting parts can be used for the conductive connections, provided that they are made of conductive material, and the contact member 9 can be omitted.

Figure 5:
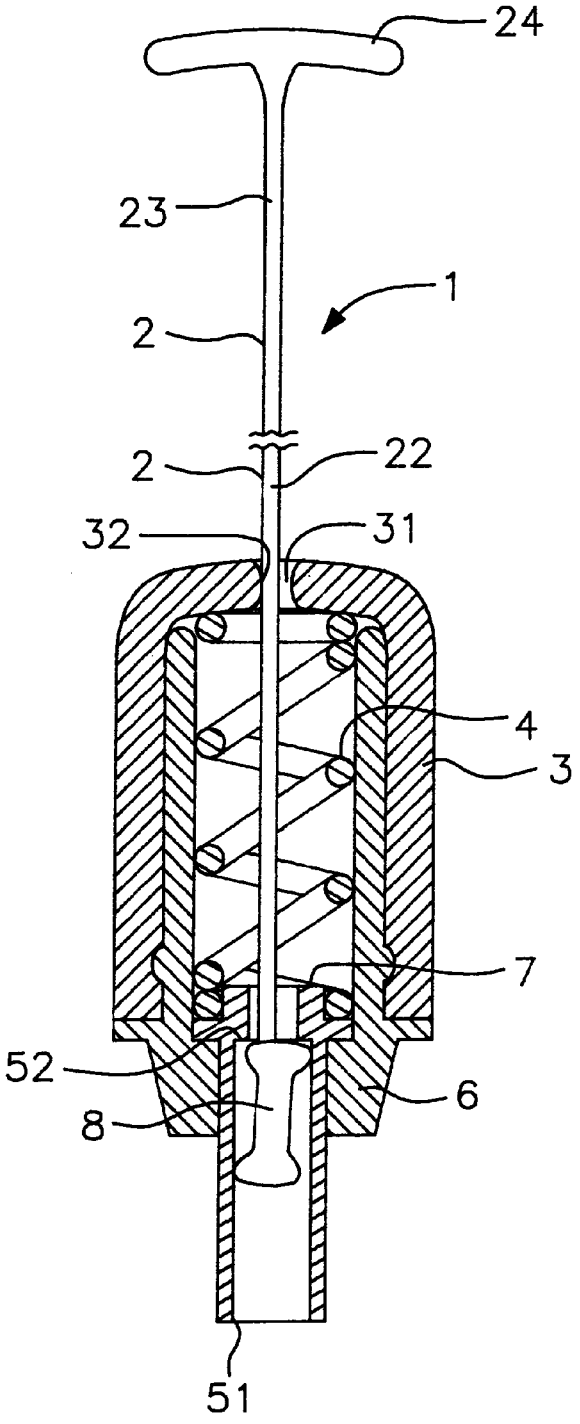
FIG. 5 is a diagrammatic partially sectional view of an antenna device, in extended position, according to a second embodiment of the invention.
Figure 6:
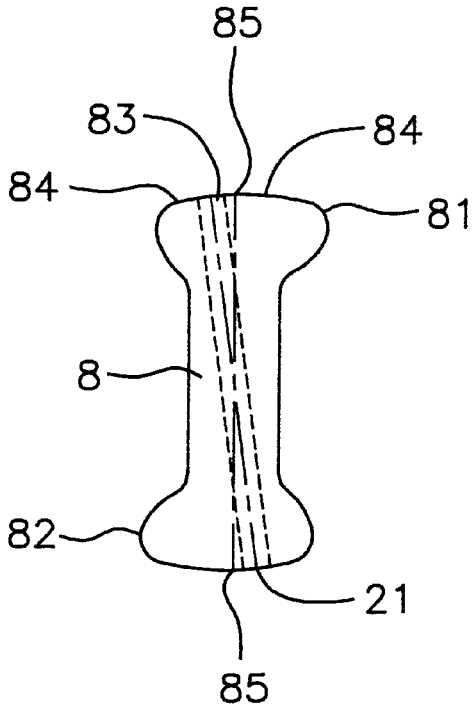
FIG. 6 is an enlarged diagrammatic side view of an enlarged portion of the antenna rod in FIG. 5.

FIG. 5 shows a second embodiment of an antenna device 1 according to the invention. This embodiment differs from that of FIG. 1 in that the enlarged portion 8 has a different shape. As seen in FIG. 6 the enlarged portion 8 has a shape like a dogbone. It may be rotation symmetrical around a longitudinal axis 85, except for the bore 83, which is provided with an angle $\alpha>0°$ in relation to the longitudinal axes 85. The enlarged portion 8 could also have planar surfaces parallel to the plane of the paper. The function and the advantages of the device of this embodiment are similar to that of the first embodiment and no further explanation is necessary.

Figure 7:
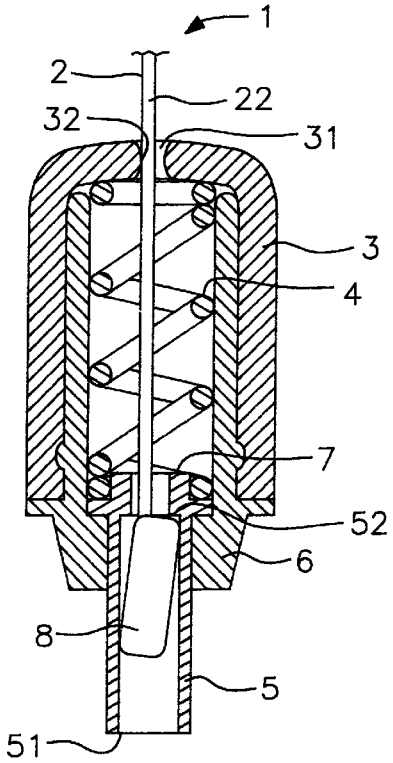
FIG. 7 is a diagrammatic partially sectional view of an antenna device, in extended position, according to a third embodiment of the invention.
Figure 8:
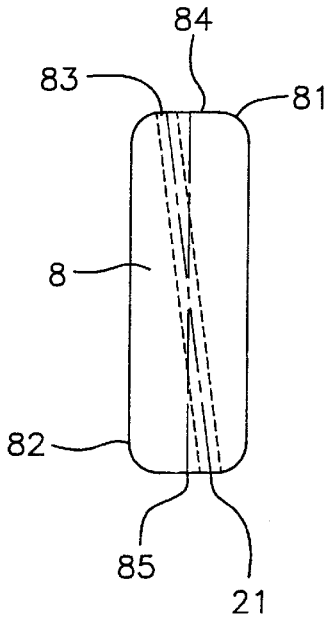
FIG. 8 is an enlarged diagrammatic side view of an enlarged portion of the antenna rod in FIG. 7.

FIG. 7 shows a third embodiment of an antenna device 1 according to the invention. This embodiment differs from that of FIG. 1 in that the enlarged portion 8 has a different shape. As seen in FIG. 8 the enlarged portion 8 has a shape like a rod with rounded ends. It may be rotation symmetrical around a longitudinal axis 85, except for the bore 83, which is provided with an angle $\alpha>0°$ in relation to the longitudinal axes 85. The enlarged portion 8 could also have planar surfaces parallel to the plane of the paper. The function and the advantages of the device of this embodiment are similar to that of the first embodiment and no further explanation is necessary.

Figure 9:
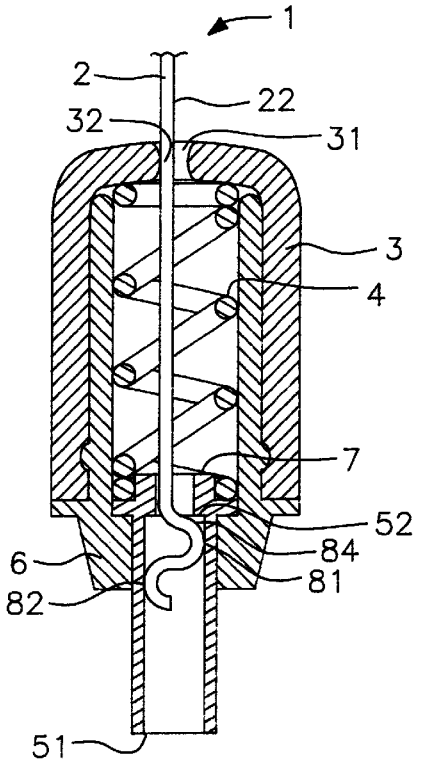
FIG. 9 is a diagrammatic partially sectional view of an antenna device, in extended position, according to a fourth embodiment of the invention.

In FIG. 9 a fourth embodiment of an antenna device 1 according to the invention is shown. In this embodiment two surfaces 81, 82 each including one contact surface are formed by bending the lower non-insulated portion of the radiating element 22. The surfaces 81, 82 are facing in different directions, preferably with a difference of 180°. The function and the advantages of the device of this embodiment are similar to that of the first embodiment and no further explanation is necessary.

Figure 10:
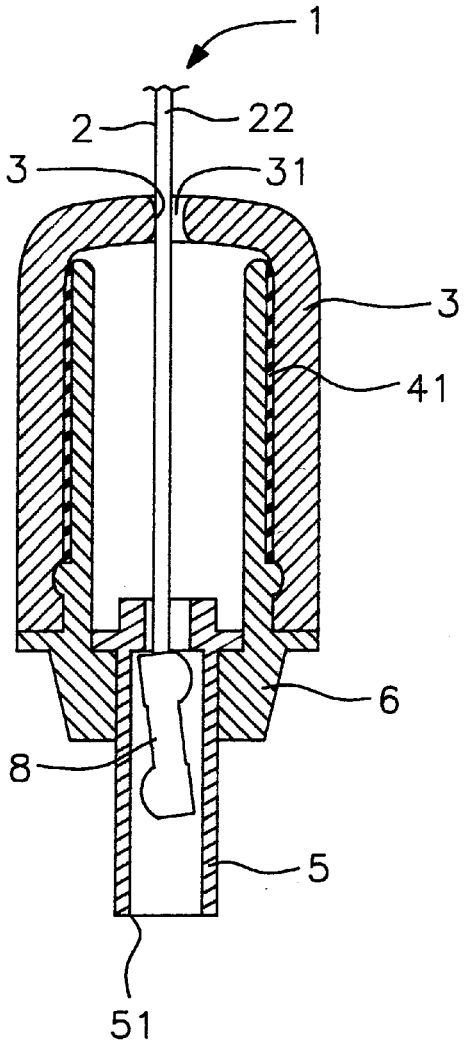
FIG. 10 is a diagrammatic partially sectional view of an antenna device, in extended position, according to a fifth embodiment of the invention.
Figure 11:
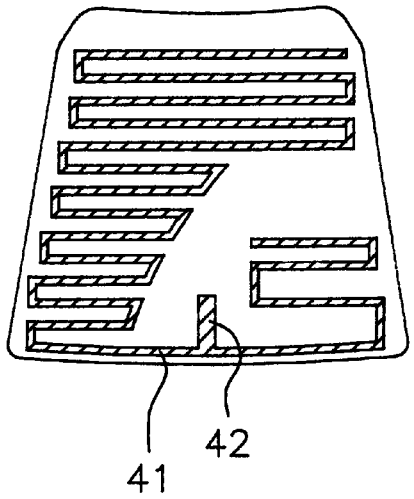
FIG. 11 shows a radiating structure included in the antenna device of FIG. 10.

In FIG. 10 a fifth embodiment of an antenna device 1 according to the invention is shown. In this embodiment the coil 4 in the previous embodiments has been deleted and a radiating structure 41 has been inserted between the base member 6 and the cover 3. The radiating structure 41 comprises, as shown in FIG. 11, a conductive pattern arranged on a flexible support, which during manufacturing is secured to the base member 6 before the mounting of the cover 3. The radiating structure 41 is connected to the transceiver circuits of the radio communication device via the feed point 42. The radiating pattern shown includes two meandering elements, even if other types of radiating patters could be used. The antenna rod 2 and the casing 5 provided in this embodiment could be of any of the above described kinds.

By the arrangement of three contact surfaces for creating a bending force in the antenna rod 2 it is achieved that the bending force, the sliding resistance and the retaining force (in extended position) are simple to predetermine. Further, the tolerance demands for the enlarged portion 8 or the curved portion of the radiating element 22 are lower than for corresponding components in prior art means. This results in simpler manufacturing with less rejection.

Although the invention is described by means of the above examples, naturally, many variations are possible within the scope of the invention. It is for example possible to arrange the enlarged portion 8 as two separate parts, e.g. as two balls having non-concentric bores, and being fixedly secured to the radiating element in suitable rotational orientations.

Further the described elongated antenna element could be the outer telescope section of a telescope antenna.

According to a sixth embodiment of the invention the extendible antenna rod is non-rotationally guided in its sliding movement through the casing. This makes it possible to control the deviation from perfect axial movement of the rod with respect to possible, slight bending in the extended position, so that the rod always bends in the same chosen direction. This is diagrammatically illustrated in FIG. 12, wherein the rod 2 and the guiding surfaces 32 of the casing each have non-circular cross section, in this case oval cross section.

It also provides the opportunity to further control the bending properties of the rod by using a radiating element having the desired rigidity in the chosen direction. As a further example, the radiating element may have increased or reduced rigidity in one chosen plane coinciding with or deviating from the bending plane.

Figure 12:
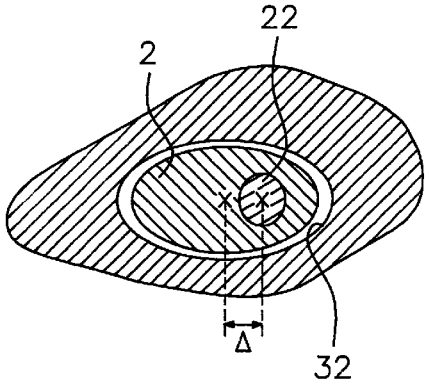
FIG. 12 is a diagrammatic partial cross sectional view of a guided antenna rod, according to a sixth embodiment of the invention.

FIG. 12 also shows the radiating element 22 being located displaced by the amount $\Delta$ from the centre position of the extendible rod inside the insulating and protecting layer. This way of arranging the radiating element unsymmetrically inside the rod provides advantages with respect to manufacture also affecting the bending properties of the antenna rod 2.

What is claimed is:

1. An antenna device for transmitting and receiving RF signals from and to a radio communication device, comprising:

an extendable elongated flexible antenna element having first and second ends, whereof the first end has a first end portion, a casing through which said antenna element is slidable between an extended position, where the first end portion is mechanically locked in the casing, and a retracted position, a first opening in a first end of the casing through which the first end portion of said antenna element is introduceable, and a second opening in a second end of the casing through which the antenna element is slidable, the first end portion is provided with first and second contact surfaces for engagement with an inner surface of the casing, the first and second contact surfaces are axially separated in relation to a longitudinal axis of the elongated antenna element and facing in different directions, a third contact surface is arranged for engagement with the elongated antenna element between the first end portion and the second end, and the contact surfaces, the casing and the elongated antenna element are arranged so as to bend the elongated antenna element to create a spring force in the elongated antenna element in order to achieve said mechanical locking in the extended position.

2. The antenna device according to claim 1, wherein the elongated antenna element, at the first end portion, exhibits first and second curved sections carrying said first and second contact surfaces, respectively.

3. The antenna device according to claim 1, wherein the elongated antenna element, at the first end portion, includes an enlarged portion on which said first and second contact surfaces are arranged.

4. The antenna device according to claim 3, wherein the enlarged portion includes an elongated body having a bore for reception of a first end of a flexible elongated radiating element comprised in the elongated antenna element, and the elongated body is provided in regions of its both ends with protrusions facing in different directions.

5. The antenna device according to claim 4, wherein each protrusion has a curved surface which includes one of said first and second contact surfaces.

6. The antenna device according to claim 5, wherein the curved surfaces are convex.

7. The antenna device according to claim 3, wherein the enlarged portion includes an elongated body having a bore for reception of a first end of a flexible elongated radiating element comprised in the elongated antenna element, and a longitudinal axis of the bore defines an angle in respect to a longitudinal axis of the elongated body.

8. The antenna device according to claim 7, wherein the elongated body is provided around a region at each of its both ends with an annular protrusion.

9. The antenna device according to claim 3, wherein the elongated antenna element includes a flexible elongated radiating element, and the enlarged portion includes a rigid member, rigidly secured to the radiating element, so that the spring action is carried out in the radiating element.

10. The antenna device according to claim 1, wherein the first and second contact surfaces are facing in directions differing essentially 180° from each other in relation to a longitudinal axis of the elongated antenna element.

11. The antenna device according to claim 1, wherein the casing is essentially tubular and provided with a constriction at its second end.

12. The antenna device according to claim 1, wherein the third contact surface has an annular shape.

13. The antenna device according to claim 12, wherein the third contact surface is arranged in connection to an opening in a cover through which the elongated antenna element is slidable.

14. The antenna device according to claim 1, wherein the casing is made of a conductive material and is connectable to transceiver circuits of the radio communication device, the first end portion includes a conductive material so that conductive contact can be established via at least one of said first and second contact surfaces.

15. The antenna device according to claim 1, wherein a second antenna element is arranged so that it at least partially surrounds the elongated antenna element.

16. The antenna device according to claim 1, wherein the casing is essentially tubular and provided with at least one planar wall portion, in a plane parallel with a longitudinal axes of the casing, and the first end portion has a surface for co-action with said planar wall portion, for guiding and preventing rotation of the antenna element.

17. The antenna device according to claim 1, wherein the casing is essentially tubular and provided with two planar wall portions, being parallel and arranged in planes parallel with a longitudinal axes of the casing, and the first end portion has surfaces for co-action with said planar wall portions, for guiding and preventing rotation of the antenna element.

18. The antenna device according to claim 1, wherein the antenna element is non-rotationally guided in the casing.

19. The antenna device according to claim 1, wherein the radiating element is located asymmetrically inside the antenna element.

20. The antenna device according to claim in combination with the radio communication device.

* * * * *